US008960408B2

(12) United States Patent
Vlasak

(10) Patent No.: US 8,960,408 B2
(45) Date of Patent: Feb. 24, 2015

(54) HANDRAIL FOR A MOVING WALKWAY

(75) Inventor: Pavel Vlasak, Sarnthein (IT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 13/980,954

(22) PCT Filed: Dec. 22, 2011

(86) PCT No.: PCT/AT2011/000511

§ 371 (c)(1),
(2), (4) Date: Jul. 22, 2013

(87) PCT Pub. No.: WO2012/097390

PCT Pub. Date: Jul. 26, 2012

(65) Prior Publication Data

US 2013/0299305 A1 Nov. 14, 2013

(30) Foreign Application Priority Data

Jan. 20, 2011 (AT) ..... A 82/2011

(51) Int. Cl.
*B66B 23/22* (2006.01)
*B66B 23/24* (2006.01)

(52) U.S. Cl.
CPC ..... *B66B 23/22* (2013.01); *B66B 23/24* (2013.01)
USPC ..... 198/335; 198/337

(58) Field of Classification Search
CPC ..... B65G 23/22; B65G 23/24
USPC ..... 198/335–337, 328
See application file for complete search history.

(56) References Cited

U.S. PATENT DOCUMENTS

| | | | | | |
|---|---|---|---|---|---|
| 3,463,290 | A * | 8/1969 | Tajima | | 198/337 |
| 4,449,623 | A * | 5/1984 | Saito et al. | | 198/335 |
| 4,809,840 | A * | 3/1989 | Nakatani | | 198/328 |
| 4,889,222 | A * | 12/1989 | Kanamori | | 198/328 |
| 5,029,690 | A * | 7/1991 | Nguyen et al. | | 198/335 |
| 5,544,729 | A * | 8/1996 | Brunn | | 198/328 |
| 7,243,775 | B2 * | 7/2007 | Novacek et al. | | 198/337 |
| 7,404,477 | B1 * | 7/2008 | Toennisson et al. | | 198/335 |
| 7,562,759 | B2 | 7/2009 | Guo et al. | | |
| 7,614,490 | B2 * | 11/2009 | Milton-Benoit et al. | | 198/337 |

FOREIGN PATENT DOCUMENTS

| | | | | | |
|---|---|---|---|---|---|
| CN | 101258094 | A | | 9/2008 | |
| DE | 577801 | C | | 6/1933 | |
| DE | 650233 | C | | 9/1937 | |
| DE | 29605458 | U1 | | 7/1997 | |
| DE | 19611655 | A1 | | 10/1997 | |
| GB | 2257679 | A | * | 1/1993 | 198/328 |
| JP | 03088694 | A | * | 4/1991 | |
| JP | 2005225636 | A | | 8/2005 | |
| JP | 2005306597 | A | | 11/2005 | |
| JP | 2006044823 | A | | 2/2006 | |
| JP | 2006044943 | A | | 2/2006 | |
| JP | 2010105801 | A | | 5/2010 | |
| WO | 2006121459 | A1 | | 11/2006 | |

* cited by examiner

*Primary Examiner* — Mark A Deuble
(74) *Attorney, Agent, or Firm* — Laurence A. Greenberg; Werner H. Stemer; Ralph E. Locher

(57) ABSTRACT

A moving walkway or escalator includes a handrail and a guide for the handrail. The handrail is driven by motor and moved along the longitudinal axis thereof at or on the guide. The handrail is guided at or on the guide along an arcuate portion of the guide while rotated or twisted about the longitudinal axis thereof, so that it can be guided more easily around curves of the moving walkway.

11 Claims, 3 Drawing Sheets

HANDRAIL FOR A MOVING WALKWAY

BACKGROUND OF THE INVENTION

Field of the Invention

The invention relates to a balustrade for a moving walkway or an escalator, having a handrail and a guide for the handrail, on which guide the handrail is moved along its longitudinal axis by motor drive.

Moving walkways and escalators which run not only over straight sections, but also over sections which can run in a horizontal plane around bends are known. It is also possible for moving walkways to be arranged not only in horizontal planes, but also in ascending or descending planes, possibly also with curved transitions between ascending or descending planes and horizontal planes. In escalators also, a transition is made between an ascending or descending transport plane into a horizontal plane. When reference is hereinafter made to a transport plane, both horizontal planes and ascending or descending planes and their transitions to horizontal planes are understood. Furthermore, when reference is hereinafter made to a moving walkway, then this applies equally to escalators insofar as these have in some portion of their transport path a bending or curvature which also includes a horizontal component.

A problem with moving walkways is that the handrail generally has a substantially higher stiffness in a plane parallel to the transport plane than in the vertical plane, since handrails, at the end of the balustrade, are normally diverted arcuately downward and can thus easily be bent in this direction or in this plane, whereas, in a plane parallel to the transport plane, they can be bent only with difficulty, or not at all, due to their geometric shape and their structure.

BRIEF SUMMARY OF THE INVENTION

The object of the invention is therefore to provide a balustrade having a handrail for a moving walkway, which balustrade is guided in a plane parallel to the transport plane, following the path of the moving walkway or escalator, around an arcuate portion.

In a balustrade of the type stated in the introduction, this object is achieved by virtue of the fact that the handrail is guided on the guide, twisted about its longitudinal axis along an arcuate portion of the guide.

Since the handrail is twisted about its longitudinal axis when the balustrade, following the moving walkway, is guided in a plane parallel to the transport plane, its stiffness is less in the plane parallel to the transport plane than if it were not twisted about its longitudinal axis, so that the handrail can more easily follow the arcuate portion of the guide and no complex measures have to be taken to reduce the stiffness of the handrail in the plane parallel to the transport plane to the point where said handrail can be guided around the arcuate portion of the guide.

It is preferred in the invention if the handrail is guided on the guide such that it is rotated through an angle of at least 45°, preferably through an angle of 75°, 80°, 85° or, in particular, 90°, about its longitudinal axis. The handrail is thereby bent, in particular at an angle of rotation of 90°, in the arcuate portion of the guide in the same plane as this is usually done at the end of the balustrade when a handrail is guided arcuately downward, so that a conventional handrail can be used.

It is preferred in the invention if the handrail is guided on the guide on a straight portion of the guide on the top side of the balustrade, and on an arcuate portion of the guide on that side of the balustrade which lies opposite that side to which the arcuate portion of the guide is bent. In this case, the handrail is disposed in a bend of the moving walkway on the outer side of the balustrade, that is to say on the side which is facing away from the center of curvature of the bend.

Alternatively, it is also possible in the invention that the handrail is guided on the guide on a straight portion of the guide on the top side of the balustrade, and on an arcuate portion of the guide on that side of the balustrade to which the arcuate portion of the guide is bent. The handrail is thus disposed in a bend of the moving walkway on the inner side of the balustrade, that is to say on the side which is facing toward the center of curvature of the bend.

In the invention, it is equally possible, however, that the handrail is guided on the guide on a straight portion of the guide on the top side of the balustrade, and on arcuate portions of the guide, which are bent on opposite sides, on correspondingly opposite sides. According to requirement, the handrail is thus disposed in one instance on the inner side and in another instance on the outer side or the top side of the balustrade.

As is known from the prior art, the handrail, in the invention, can be guided at the end of a balustrade, on the top side of the balustrade, articulately downward on the guide. It can also however be bent at the end of the balustrade, as described above, in a plane parallel to the transport plane through 180° and can be guided, for example, to a moving walkway running in the opposite direction.

BRIEF DESCRIPTION OF THE SEVERAL VIEWS OF THE DRAWING

Further features and advantages of the invention emerge from the following description of preferred illustrative embodiments of the invention with reference to the attached drawings, wherein.

DESCRIPTION OF THE INVENTION

Figure 1:
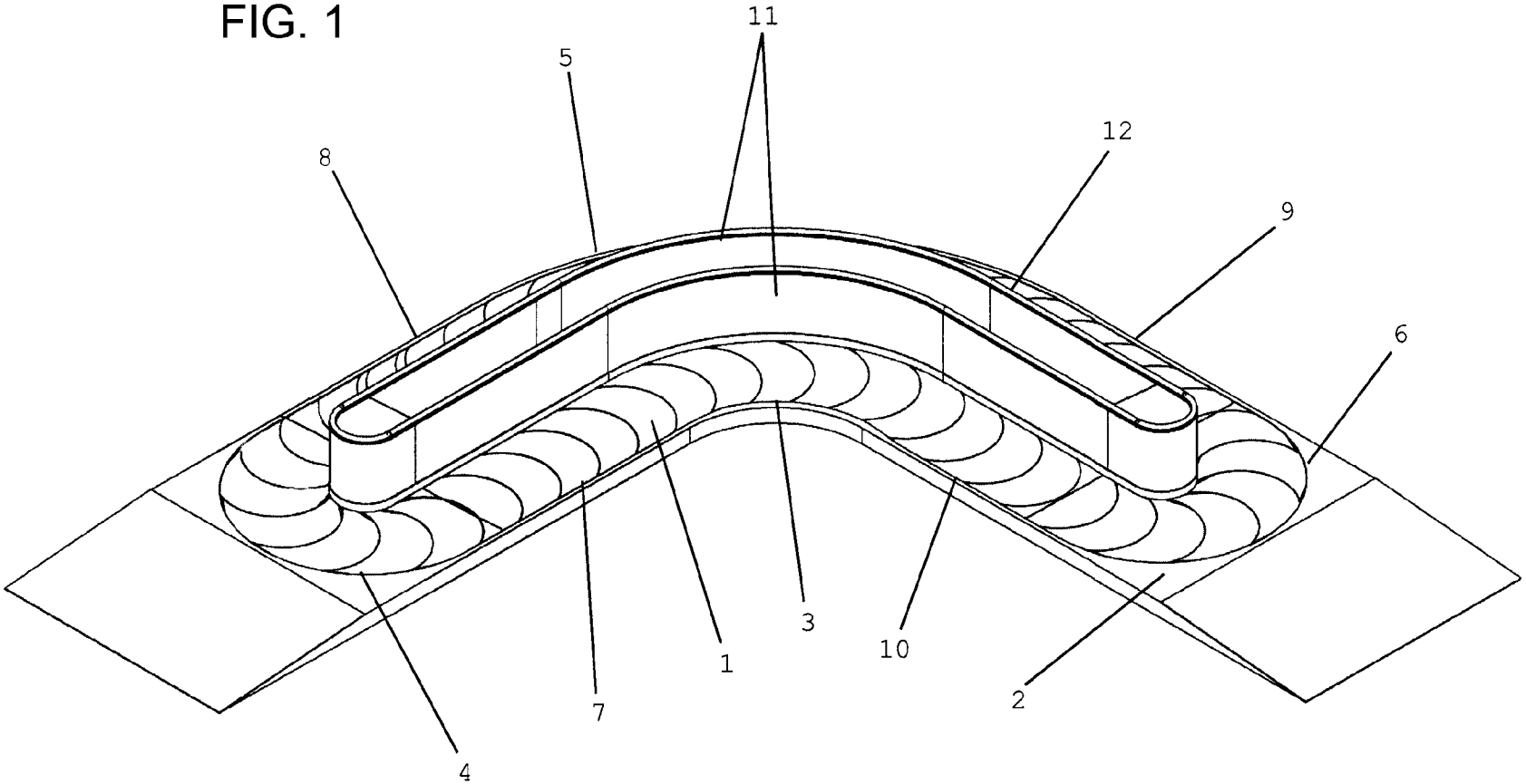
FIG. 1 shows a moving walkway having an inventive balustrade in a first embodiment.

In FIG. 1 is represented a moving walkway 1, which travels in an, in the represented embodiment, horizontal transport plane 2 around a plurality of bends 3, 4, 5, 6 between which are found straight transport sections 7, 8, 9, 10. As is known per se, the moving walkway 1 consists of a multiplicity of roughly sickle-shaped plates, which are connected to one another such that they can travel both around bends 3, 4, 5, 6 and along straight transport sections 7, 8, 9, 10.

Along the moving walkway 1 is arranged a balustrade 11 having a handrail 12, which balustrade follows the path of the moving walkway 1, persons being able to hold on to the handrail 12, which is moved at the same speed as the moving walkway 1, as they are transported on the moving walkway 1.

Figure 5:
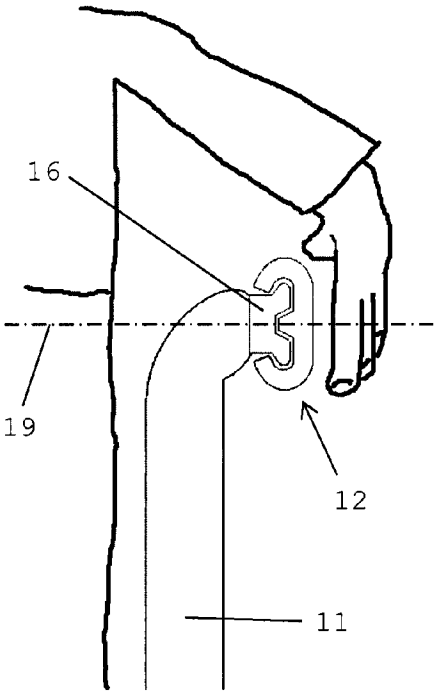
FIG. 5 shows a handrail in a third position.
Figure 4:
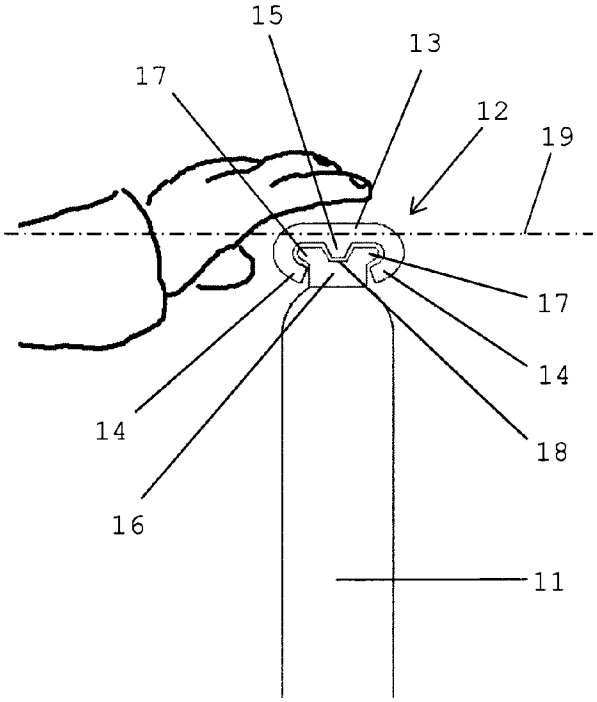
FIG. 4 shows a handrail in a second position.
Figure 3:
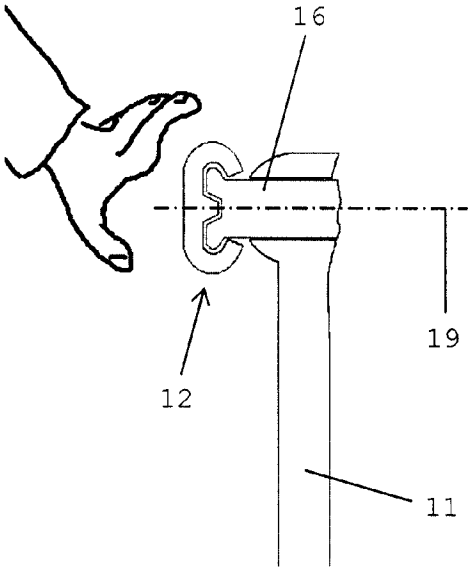
FIG. 3 shows a handrail in a first position.

As can be seen in the illustrative embodiment of FIGS. 3 to 5, the handrail 12 has a substantially C-shaped cross section having a flat spine 13 and arm ends 14 which are bent toward each other. On the spine 13 is disposed a rib 15 running in the longitudinal direction of the handrail 12, which rib is directed toward the inside of the C-shaped cross section. In this illustrative embodiment, the handrail is guided on a roughly Y-shaped guide 16 having a groove 18 which is disposed between arms 17 and in which the rib 15 of the handrail 12 is guided. The arms 17 of the guide 16 are embraced by the bent-over arm ends 14 of the handrail 12.

As FIG. 4 shows, the guide 16, disposed on the top side of the balustrade 11, can point upward, whereby the handrail 12 is disposed on the top side of the guide 16 and thus of the balustrade 11. According to the invention, this position of the handrail 12 is used preferably for rectilinear transport sections, for example the transport sections 7, 8, 9, 10 according to FIGS. 1 and 2.

Since the handrail 12, in a plane 19 lying parallel to the transport plane 2, can be bent only with difficulty, or not at all, it would be difficult to travel with the handrail 12 around bends 3, 4, 5, 6. According to the invention, the handrail 12 is therefore twisted along its longitudinal axis, in the illustrative embodiment according to FIG. 3 through 90° to the left and in the illustrative embodiment according to FIG. 5 through 90° to the right. In the position according to FIGS. 3 and 5, the handrail 12 can easily be bent in the plane 19, so that it is also possible with the handrail 12 to follow the bends 3, 4, 5, 6. Depending on the shape of the handrail 12, it would theoretically also be possible to rotate the handrail 12 not through 90° , but through an angle less than 90° , for example only 45° , 75° , 80° or 85° , since the stiffness of the handrail 12 in the direction of the plane 19 is then already less than in the position according to FIG. 4. In the invention, a twisting of the handrail through 90° is however preferred.

The handrail 12 could, for example, assume the position according to FIG. 3 in the region of the bends 4 and 6 of FIG. 1, whereby the handrail is disposed, so to speak, on the outer side of the balustrade 11, i.e. on the side facing away from the center of curvature of the bend 4, 6, and the position according to FIG. 5 in the region of the bends 3 and 5 of FIG. 1, wherein the handrail is disposed in the bend 5, so to speak, on the inner side of the balustrade 11, i.e. on the side facing toward the center of curvature of the bend 5, and in the bend 3 back on the outer side of the balustrade. On at least one bend 3, 4, 5, 6, the handrail 12 is preferably disposed on an outer side, since it can then, for example, very easily be motor driven by means of a V-belt wheel.

Figure 2:
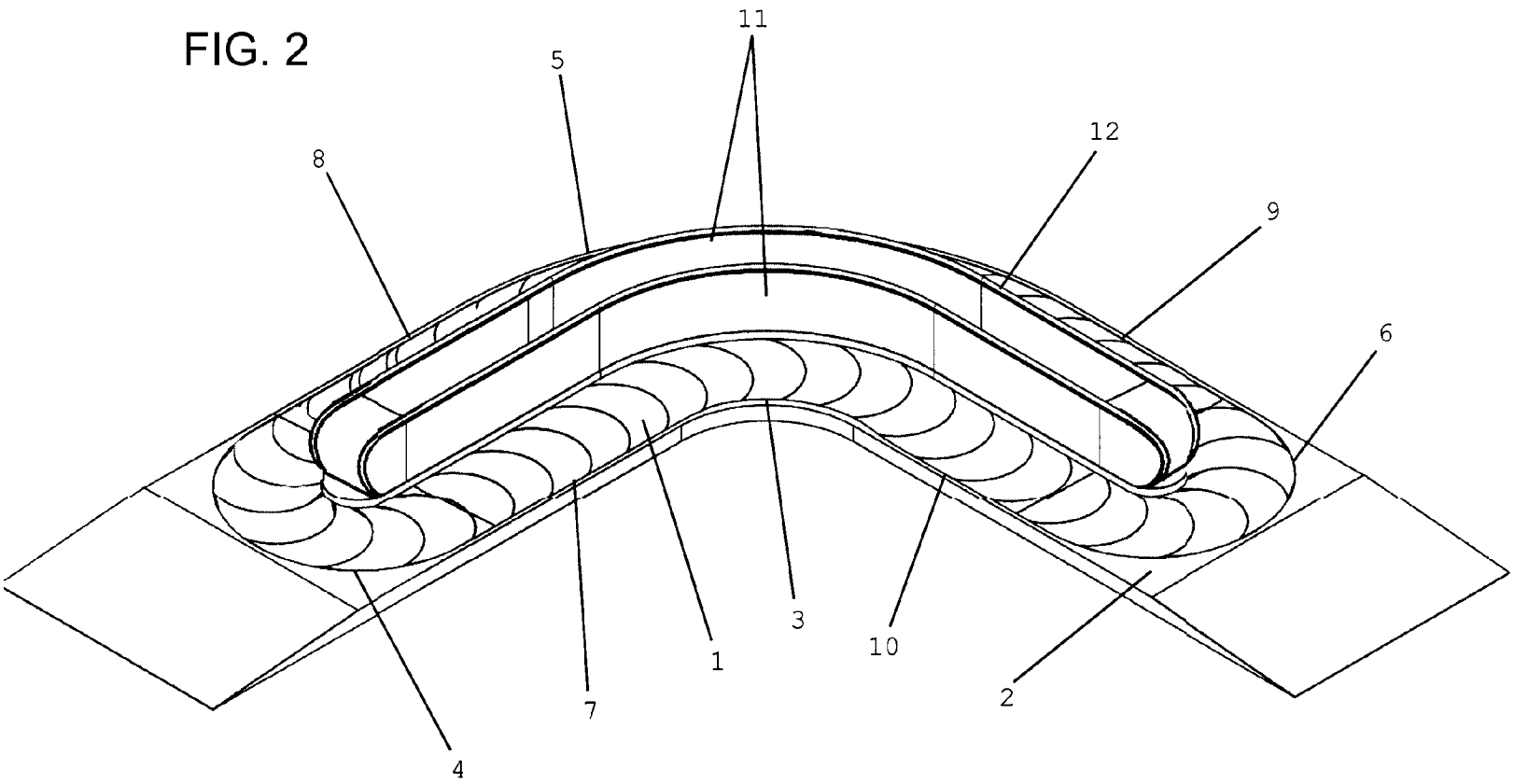
FIG. 2 shows a moving walkway having an inventive balustrade in a second embodiment.

In FIG. 2, at the end of the balustrade 11 (in the region of the bends 4 and 6), the handrail 12 is guided arcuately downward on the guide 16, as is known per se from the prior art, so that, on its guide 16, it maintains its position on the balustrade 11 substantially as represented in FIG. 4 when leaving a straight transport section 7, 8, 9, 10, in which it, as described above, preferably likewise assumes the position represented in FIG. 4, or entering said transport section. In comparison to the embodiment according to FIG. 1, the handrail 12 could then, for example, assume only the positions according to FIGS. 4 and 5, but not that according to FIG. 3.

If the moving walkway 1 not only runs in a horizontal plane 2, as in the illustrative embodiments represented in FIGS. 1 and 2, but passes from a horizontal plane into an inclined plane, and in this transition region a bend is possibly present, then in this transition region or bend region it is advantageous if the handrail 12 is rotated not through 90°, but through an angle less than 90° about its longitudinal axis, the spine 13 of the handrail 12 is thus rotated through an angle between 0° and 90°, since the optimal bending plane of the handrail 12 can then be adapted to the curvature of the path of conveyance and thus of the guide 16.

The invention claimed is:

1. A balustrade for a moving walkway or an escalator, the balustrade comprising:

a guide having an arcuate portion and a straight portion;

a top of the balustrade, one side of the balustrade at which said arcuate portion of said guide is bent and another side of the balustrade opposite said one side; and a handrail having a longitudinal axis;

said handrail being guided on said top of the balustrade at said straight portion of said guide;

said handrail being guided on said other side of the balustrade opposite said one side at which said arcuate portion of said guide is bent;

said handrail configured to be motor-driven on and guided by said guide along said longitudinal axis of said handrail and said handrail configured to be twisted about said longitudinal axis of said handrail while guided along said arcuate portion of said guide.

2. The balustrade according to claim 1, wherein said handrail is rotated through an angle of at least 45° about said longitudinal axis of said handrail while being guided on said guide.

3. The balustrade according to claim 1, wherein said handrail is rotated through an angle of 75°, 80° or 85° about said longitudinal axis of said handrail while being guided on said guide.

4. The balustrade according to claim 1, wherein said handrail is rotated through an angle of 90° about said longitudinal axis of said handrail while being guided on said guide.

5. The balustrade according to claim 1, wherein:

said arcuate portion is one of a plurality of arcuate portions being bent on opposite sides; and said handrail is guided on said other sides of the balustrade opposite said one side at which said arcuate portion of said guide is bent.

6. The balustrade according to claim 1, which further comprises:

an end and a top of the balustrade;

said handrail being guided articulately downward on said guide at said end of the balustrade on said top of the balustrade.

7. A balustrade for a moving walkway or an escalator, the balustrade comprising:

a guide having an arcuate portion and a straight portion, said arcuate portion being one of a plurality of arcuate portions being bent on opposite sides;

a top of the balustrade;

a side of the balustrade at which said arcuate portion of said guide is bent, said side of the balustrade being one of two opposite sides; and a handrail having a longitudinal axis;

said handrail configured to be motor-driven on and guided by said guide along said longitudinal axis of said handrail and said handrail configured to be twisted about said longitudinal axis of said handrail while guided along said arcuate portion of said guide;

said handrail being guided on said top of the balustrade at said straight portion of said guide;

said handrail being guided on said sides of the balustrade opposite said side at which said arcuate portion of said guide is bent.

8. A balustrade for a moving walkway or an escalator, the balustrade comprising:

a guide having an arcuate portion; and a handrail having a longitudinal axis and a longitudinal direction;

said handrail being configured to be motor-driven on and guided by said guide along said longitudinal axis of said handrail and said handrail configured to be twisted about said longitudinal axis of said handrail while guided along said arcuate portion of said guide;

said handrail including a C-shaped cross section having a spine with an inner side; and a rib disposed on said inner side, running in said longitudinal direction of said handrail and being guided in a groove in said guide.

9. The balustrade according to claim 8, wherein said spine is straight.

10. A balustrade for a moving walkway or an escalator, the balustrade comprising:

a guide having arcuate and straight portions;

said arcuate portions having one side of the balustrade at which said arcuate portion of said guide is bent and another side of the balustrade opposite said one side;

a bottom of the balustrade disposed in the vicinity of the moving walkway or escalator and a top of the balustrade disposed opposite the moving walkway or escalator;

a handrail having a longitudinal axis;

said handrail configured to be motor-driven on and guided by said guide along said longitudinal axis of said handrail and said handrail configured to be twisted about said longitudinal axis of said handrail while guided along said arcuate portion of said guide;

said handrail being guided on said top of the balustrade at said straight portion of said guide; and said handrail being guided on said side of the balustrade opposite the moving walkway or escalator in said arcuate portion of said guide.

11. The balustrade according to claim 10, wherein:

said arcuate portion is one of a plurality of arcuate portions being bent on opposite sides; and said handrail is always guided on one of said sides of the balustrade opposite the moving walkway or escalator in said arcuate portions of said guide.

* * * * *